United States Patent [19]

MacBain

[11] Patent Number: 4,537,535

[45] Date of Patent: Aug. 27, 1985

[54] ROCK REINFORCEMENT

[76] Inventor: John W. MacBain, 205 Anderson Ave., Northcliff Ext. 2, Johannesburg, Transvaal, South Africa

[21] Appl. No.: 391,288

[22] Filed: Jun. 23, 1982

[30] Foreign Application Priority Data

Jun. 25, 1981 [ZA] South Africa ..... 81/4291

[51] Int. Cl.[3] ..... E21D 20/02

[52] U.S. Cl. ..... 405/260; 411/57

[58] Field of Search ..... 405/234, 237, 259, 260, 405/261, 225; 166/292; 285/284, 382.5; 299/20; 411/19, 20, 57, 60, 61, 63

[56] References Cited

U.S. PATENT DOCUMENTS

| | | | |
|---|---|---|---|
| 2,591,807 | 4/1952 | Greene | 405/234 X |
| 3,148,577 | 9/1964 | Parsons | 405/259 X |
| 3,349,567 | 10/1967 | Munn | 405/259 |
| 4,012,913 | 3/1977 | Scott | 405/259 X |
| 4,400,113 | 8/1983 | Chaiko et al. | 405/261 |
| 4,459,067 | 7/1984 | Skogberg et al. | 405/259 |

FOREIGN PATENT DOCUMENTS

| | | | |
|---|---|---|---|
| 1965776 | 7/1971 | Fed. Rep. of Germany | 405/261 |
| 742,599 | 6/1980 | U.S.S.R. | 405/261 |
| 802554 | 2/1981 | U.S.S.R. | 405/259 |

*Primary Examiner*—David H. Corbin

*Attorney, Agent, or Firm*—McGlew and Tuttle

[57] ABSTRACT

Rock reinforcement wherein a tubular member e.g. of steel is expanded by means of a non-explosive demolition agent into frictional contact with the wall of a hole formed in a rock face.

20 Claims, 10 Drawing Figures

ROCK REINFORCEMENT

BACKGROUND OF THE INVENTION

This invention relates to the reinforcing of rock.

Interior rock fixtures such as friction rock stabilizers, dowels, resin based systems and standard mechanical roof bolts with expanding heads are widely used underground for rock support.

Friction rock stabilizers have particular advantages in that they have no moving parts and that they do not overstress the rock. Such devices however must be installed with the aid of suitable machinery which force the devices in to holes formed in the rock. Moreover the holding force which is achievable with a stabilizer of this kind is limited in that under practical conditions the maximum radial outward force exerted on the wall of the hole by the stabilizer is in the region of 50 psi.

SUMMARY OF THE INVENTION

It is an object of the present invention to provide an alternative method of reinforcing rock.

The invention provides a method of reinforcing rock which includes the step of placing a non-explosive demolition agent in a hole formed in the rock.

The agent may be used to anchor or otherwise secure one or more load bearing members in the hole. This may be achieved, for example, by forcing a surface of the member into frictional contact with the wall of the hole.

In one form of the invention the agent is used to expand a tubular member radially into contact with the wall.

Thus the invention extends to a method of reinforcing rock wherein a non-explosive demolition agent is placed inside a tubular load bearing member, and the member is located in a hole in the rock where the agent is permitted to expand the member into contact with the wall of the hole.

The method may include the step of permitting a component of the member or means located in the member, or otherwise associated with the member, to deform when the agent exerts a predetermined pressure. This allows the maximum pressure exerted by the agent to be controlled.

In a different form of the invention reinforcement means are embedded in the agent which expands an outer member into contact with the wall of the hole, or which itself expands into direct wall contact.

The invention also provides apparatus for reinforcing rock which comprises at least one generally tubular member adapted to receive, and to be expanded radially by, a non-explosive demolition agent.

The tubular member may be split longitudinally, and may include sealing means over the slit.

The tubular member may include one or more deformable sections which extend longitudinally. Alternatively or additionally the member may include a core or a filler which may be deformable.

The agent may be contained in a container located in the tubular member. The container may be flexible, extensible, stretchable or frangible.

The tubular member may include at least one plug or other seal for sealing the agent inside the tubular member.

In another form of the invention the apparatus comprises an elongate reinforcing member located at least partly in a container which is filled at least partly with the agent. The container may be an extensible, flexible or stretchable tubular container e.g. of a plastics material.

BRIEF DESCRIPTION OF THE DRAWINGS

The invention is further described by way of examples with reference to the accompanying drawings in which.

DESCRIPTION OF PREFERRED EMBODIMENTS

The invention is based on the use of a non-explosive demolition agent of the type recently made available under the trade name "Bristar". This agent consists of a material which is mixed with water whereafter the mixture is used for demolition purposes. The mixture is for example poured into a hole bored in a rock and after a period of plus minus five hours the mixture sets and simultaneously expands exerting very high expansive forces on the wall of the rock thereby causing it to shatter.

"BRISTAR" is sold by the Onoda Cement Company of Japan and consists of a silicate inorganic compound, and an organic compound c.f. FARMER'S WEEKLY, July 8, 1981, Page 10.

By adding suitable fillers e.g. inert materials to the mixture the ultimate expansive force can be controlled to a desired value. Alternatively if compressible materials are located in the liquid mixture these materials are deformed when the expansive forces reach predetermined levels and in this way the pressure can be controlled. These control techniques which fall within the scope of the invention may be employed in conjunction with the devices hereinafter described to regulate the characteristics of the stabilizing systems.

Figure 1:
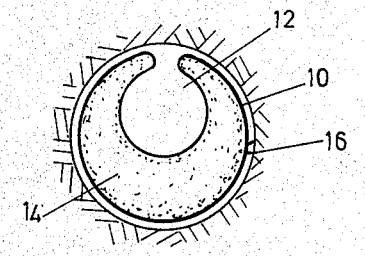
FIGS. 1 to 5 are schematic sectioned end views of reinforcing apparatus according to different embodiments of the invention.

FIG. 1 illustrates a tubular member 10 which is formed with an inwardly extending formation 12. The formation 12 extends axially along the entire length of the member 10. The member may be made of any suitable material but for the purposes of economy and strength it is made from a suitable grade of steel.

In accordance with the invention the demolition agent is prepared and then poured into the interior 14 of the member 10. The ends of the member 10 may be closed by means of suitable plugs or seals although under certain conditions this aspect may not be so important and the primary concern will be simply to prevent the mixture from running out of the member 10. Clearly the measures taken in this regard will be determined at least partly by the inclination of the member 10 in use.

Once the member 10 has been filled with the mixture and sealed it is inserted into a hole 16 formed in a rock face. The member 10 is left in position and where necessary use may be made of simple wedges to retain it in the hole, for example if the holes extend vertically.

After a period of about five hours, depending inter alia on environmental conditions, the mixture starts setting and simultaneously starts expanding. The wall of the member 10 is thereby forced radially outwardly and in to frictional contact with the wall of the hole. The formation 12 deforms on the one hand due to the outward movement of the member 10 and, on the other hand, is forced inwardly by the compressive forces exerted by the expanding mixture. The formation 12 can be designed to deform substantially when the expansive forces reach predetermined levels in order to limit the ultimate expansive force exerted by the mixture. This may be of importance as a precaution against the mixture exerting expansive forces which are sufficiently high to split the rock face.

Figure 2:
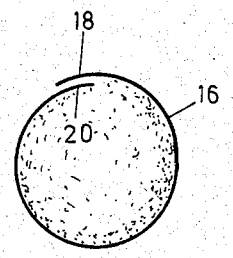

FIG. 2 illustrates a member 16 which commprises a split tube with one longitudinal edge 18 overlapping and in close contact with the other longitudinal edge 20 of the split. The device is used in the manner described in connection with FIG. 1 but in this example the radial outward movement of the tube is allowed for by the edges 18 and 20 sliding over each other. These edges are in close contact with each other and thereby provide a sealing action which prevents the mixture from escaping from the slit.

Figure 3:
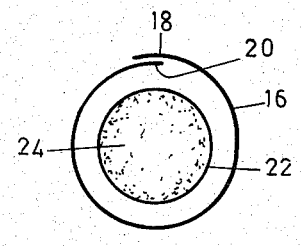

If the seal between the two edges 18 and 20 is not satisfactory or, if for any reason it is desired to have the demolition agent in a packaged state, then use may be made of a flexible bag 22 which accommodates the mixture 24 and which is located inside the tubular member 16. An arrangement of this kind is illustrated in FIG. 3. In other respects the device functions in the manner already described.

Figure 4:
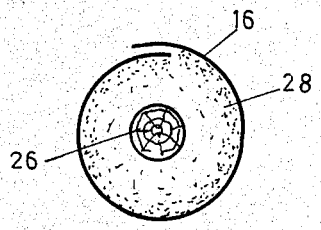

A further variation is illustrated in FIG. 4 where the member 16 has an elongate core 26 inside it. The core 26 may for example be a second tube or be of wood or some other deformable material. The demolition agent 28 is inserted into the annulus between the tube 16 and the core 26. The core serves a dual function in that it limits the amount of demolition agent needed to expand the tube 16 and secondly it offers some means of controlling the expansive forces in that it itself, i.e. the core, collapses inwardly when the expansive forces reach predetermined values.

Figure 5:
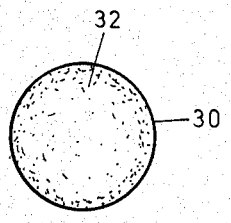

FIG. 5 illustrates a tube 30 of circular cross section filled with demolition agent 32. As before the tube may be sealed at one or both ends. In this instance the demolition agent exerts sufficient force on the tube to expand it radially outwardly into contact with the wall of the hole either by causing the tube to break at one or more locations in the longitudinal direction so that it is forced into contact with the wall of the hole or by causing the tube material to flow e.g. by reason of its ductility.

Figure 6:
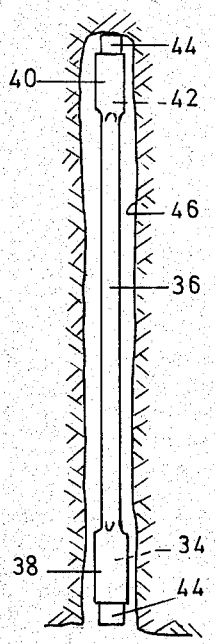
FIGS. 6 to 9 are schematic side views of further embodiments of apparatus according to the invention.

The arrangement illustrated in FIG. 6 consists of a tube 34 which is flattened at a central region 36 thereby forming two relatively short tubular sections 38 and 40 respectively at opposed ends of the tube. These sections are filled with the demolition agent 42 and are sealed by means of plugs 44. The tube is then inserted into a hole 46 and the sections 38 and 40 are allowed to expand under the action of the demolition agent. This construction allows the quantity of the demolition agent to be minimised and allows the apparatus to extend under load with the flattened portion 36 merely acting as a coupling member between the two anchoring portions 38 and 40. Clearly the principle employed here can be extended to provide a device which engages with the wall of the hole at a plurality of distinct and spaced locations.

Figure 7:
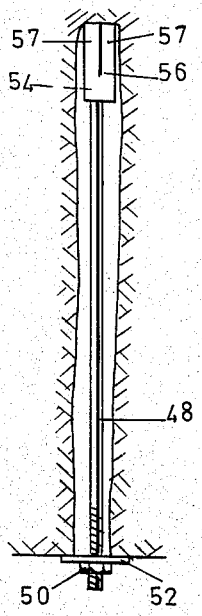

FIG. 7 illustrates a device which is generally similar to a conventional mechanical expanding head type roof bolt. The device has a shank 48 terminated by a nut 50 which bears on a washer 52. The expanding head normally encountered is however replaced by means of a tubular section 54 which in use is expanded by means of the demolition agent 56. After the agent has set the nut 50 is tightened in the conventional manner. The tubular section could be split partly from the top, say into four sections 57, to facilitate it expansion. It should be mentioned that in all the preceding cases it is possible to use the demolition agent in conjunction with other systems of support e.g. the principles described thusfar can be combined with resin based systems, frictional rock stabilizers, mechanically tensioned rock bolts, etc.

Figure 8:
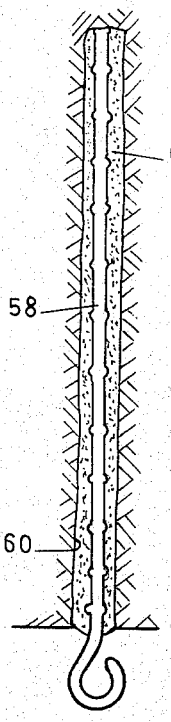

The device of FIG. 8 is slightly different from the preceding devices in that the demolition agent is not used to establish direct frictional contact between a reinforcing member and the wall of the hole. In this instance a reinforcing rod 58 is inserted into a tube 60 which is filled with demolition agent 62. The tube 60 is sealed at each of its ends. The assembly is then forced into a hole in the rock face and the demolition agent is allowed to expand. The tube 60 may for example be of plastics or some other flexible, frangible or extensible material and as the demolition agent expands it forces the tube into contact with the wall of the hole. Alternatively the demolition agent escapes from the tube and itself contacts the wall of the hole. The demolition agent is simultaneously in contact with the rod and thus exerts a compressive force between the rod and the wall of the hole. Once the agent has set the rod 58 is firmly embedded in position. The process described is similar in many respects to a grouting operation but differs from it in that the medium used to secure the rod itself exerts retentive forces. Again it is possible to combine the concepts described with conventional techniques and to use the demolition agent together with a grouting medium or some other system.

Figure 9:
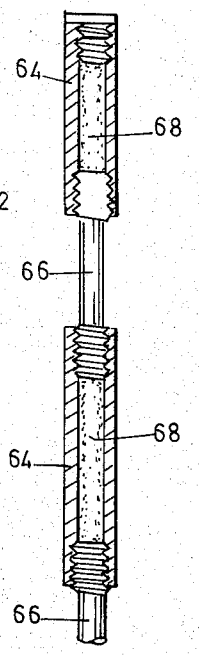

FIG. 9 illustrates a variation of the invention which includes a number of spaced tubular housings 64 interconnected by means of screwed rods 66. The housings are filled with demolition agent 68. Each housing is filled in turn with the agent and one of the rods 66 is screwed into its mouth to seal it, and into the opposed end of the successive housing. The latter housing is then filled with the agent 68 and the process is repeated. The lengths of the individual housings, the number of housings used, and the spacings between the respective housings, are chosen according to requirements and, in this way, it is possible by fabricating a number of two standard components i.e. the housings 64 and the rods 66, to provide a kit which permits the assembly of a rockbolt to meet on-the-spot specifications.

Clearly, if desired, certain of the housings 64 in an assembly of the kind described need not be filled with the demolition agent, and the rods could be replaced by lengths of cable crimped or otherwise fixed to the housings.

In use of the assembly of FIG. 9 those housings which contain the demolition agent are expanded by it in the manner described and thus force the housings into close frictional contact with the wall of a hole in a rockface.

It should be mentioned that the walls of the housings could be split or weakened to facilitate expansion of the housings.

In FIG. 3 reference is made to a flexible bag 22 which contains the demolition agent 24. It is envisaged in that application that the mixture is prepared and then poured into the bag which is located in, or which is then inserted into, the tubular member. This technique may also be used with the other embodiments of the invention.

Figure 10:
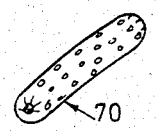
FIG. 10 illustrates a component for use in the apparatus of the invention.

It is also possible though to make use of the technique shown in FIG. 10 in which the demolition agent is prepackaged in elongate flexible bags, or rigid containers, generally designated with the numeral 70, which are water permeable, or which are holed, or treated or made in any other suitable way so that when the bag or container is immersed in water, the water can enter the bag or container and react with the demolition agent in a satisfactory manner. The bag could for example be formed from holed or perforated plastics, tissue paper or the like. This approach eliminates the mixing problem. If the bag merely serves as a carrier for the agent it is then placed in a hole and pierced with a rod as shown in FIG. 8, or is placed in the tubular section or housing of the rock bolt of any of the other embodiments of the invention.

On the other hand if the container 70 is for example made of a perforated steel tube which is sufficiently strong to act as a rockbolt itself it is inserted into a hole in the rockface and used as is, acting in the manner already described.

Thus, in accordance with the invention, in the various embodiments of the invention, the tubular section or housings which take the demolition agent may be apertured or holed in such a way as to permit the ingress of water when immersed in water, whilst stopping the outflow of the resulting wet mixture. These sections may then be prepackaged with the agent.

Alternatively these sections may be prepackaged with the agent which is held in permeable or apertured bags, of the type already described.

The demolition agent which may be used in the invention is obviously not limited to that sold under the name Bristar and any non-explosive material which exhibits the desired properties may be used in its stead. The invention is based on the use of a demolition agent which exerts very high expansive forces when setting. These expansive forces are used to secure a reinforcing member in a hole in a rock face. Clearly these principles may be utilised in many different ways and can find expression in embodiments which differ substantially from those illustrated in the accompanying drawings. Such embodiments are however all intended to fall within the scope of the invention.

The member expanded by the demolition agent could be of any suitable material which exhibits the desired strength, e.g. mild or spring steel, fibreglass with longitudinally extending filaments, etc. In applications in which the rockbolt may be sheared by a rock cutter during mining operations e.g. in a coal mine, the member could be made from a suitable plastics or other material which may be sheared or severed without damaging the cutting machine. The demolition agent, when set, is not unduly hard, and may be quite powdery, and thus does not damage the cutting machine either. When use is made of a tube, for example of the kind shown in FIG. 5, the wall of the hole could be weakened to ensure that it splits along a predetermined line.

It will be clear from the foregoing that the demolition agent or non-explosive material is a delayed action and in situ self-expandable settable material, e.g. a water-activated material, and constitutes inherently a volume increasing settable and expandable material which in initial unset and unexpanded condition occupies a given volume and in final set and expanded condition occupies an increased volume relative to said given volume, and which is capable of changing from its unset to its set condition over a period of setting time and during its setting time is capable of increasingly expanding and as it expands of increasingly generating a compressive force in the expanding direction of its increasing volume until it reaches its final set and expanded condition and occupies said increased volume. Of course, the supply of such non-explosive material used is understandably such that it is sufficient upon setting to maintain the frictional contact relation of the tubular member or reinforcing member with the hole in the rock or rockface but insufficient during and upon setting to split or shatter the rock or rockface around the hole.

I claim:

1. Apparatus component assembly combination for reinforcing a hole formed in rock comprising:

as first component at least one expandable tubular member having a longitudinally extending bore and adapted to be placed in a hole formed in rock, and as second component in combination therewith a selective supply of a volume increasing settable and expandable non-explosive material which in initial unset and unexpanded condition occupies a given volume and in final set and expanded condition occupies an increased volume relative to said given given volume, and which non-explosive material is capable of changing from its unset to its set condition over a period of setting time and during its setting period is capable of increasing expanding and as it expands of increasingly generating a compressive force in the expanding direction of its increasing volume until it reaches its final set and expanded condition and occupies said increased volume, said supply of non-explosive material being disposed within the bore of the tubular member, such that when the tubular member is disposed in said hole formed in the rock, said non-explosive material upon changing from its unset to its set condition during its setting period causes the adjacent portion of the tubular member to expand outwardly into frictional contact with said hole in the rock, said supply of non-explosive material being sufficient upon setting to maintain and frictional contact but being insufficient during and upon setting to split the rock.

2. A combination of claim 1, wherein said tubular member is split along at least one longitudinal line.

3. A combination of claim 1, wherein said tubular member is split along at least one longitudinal line to form at least one corresponding slit, and including means sealing each such slit.

4. A combination of claim 1, wherein said tubular member is split along at least one longitudinal line to form at least one pair of corresponding edges along the corresponding slit, and such pair of edges overlap each other.

5. A combination of claim 1, wherein said tubular member includes at least one longitudinally extending deformable formation.

6. A combination of claim 1 further including container means for containing said supply of non-explosive material, said supply of non-explosive material being contained in said container means and said container means being disposed within said bore of the tubular member.

7. A combination of claim 6, wherein said container means is in the form of the water-permeable container.

8. A combination of claim 6, wherein said container means includes at least one aperture therein to permit the ingress of water thereinto to mix with said supply of non-explosive material within said container means.

9. A combination of claim 1, wherein said tubular member is deformable by said non-explosive material.

10. A combination of claim 1, wherein said tubular member includes at least one aperture therein to permit the ingress of water thereinto.

11. A combination of claim 1, further including a filler material admixed with said supply of non-explosive material for controlling the degree of expansion thereof and the compressive force generated thereby.

12. A combination of claim 1, further including a rod at least partially inserted into said supply of non-explosive material.

13. A combination of claim 1, wherein said non-explosive material comprises a water-activated settable mixture of a silicate inorganic compound and an organic compound.

14. A combination of claim 1, further including a compressive means disposed in said supply of non-explosive material for controlling the degree of expansion thereof and the compressive force generated thereby.

15. A combination of claim 1, wherein said non-explosive material is an in situ self-expandable settable material.

16. Method of reinforcing rock comprising the steps of disposing in a hole formed in rock an expandable tubular member containing therein a selective supply of a volume increasing settable and expandable non-explosive material which in initial unset and unexpanded condition occupies a given volume and in final set and expanded condition occupies an increased volume relative to said given volume, and which non-explosive material is capable of changing from its unset to its set condition over a period of setting time and during its setting time is capable of increasingly expanding and as it expands of increasingly generating a compressive force in the expanding direction of its increasing volume until it reaches its final set and expanded condition and occupies said increased volume, and causing said non-explosive material to change from its unset to its set condition to deform said tubular member into frictional contact with the wall of the hole during the setting period of said non-explosive material, said supply of non-explosive material being sufficient upon setting to maintain said frictional contact but being insufficient during and upon setting to shatter the rock.

17. Method of claim 16, including the further step of controlling the maximum force exerted by the non-explosive material by locating a deformable means in a part of the non-explosive material prior to causing said non-explosive material to change from its unset to its set condition.

18. Method of claim 16, wherein a filler material is admixed with said supply of non-explosive material for controlling the degree of expansion thereof and the compressive force generated thereby.

19. Method of claim 16, wherein said non-explosive material is an in situ self-expandable settable material.

20. Method of claim 16, wherein said non-explosive material comprises a water-activated settable mixture of a silicate inorganic compound and an organic compound.

* * * * *